US006163891A

United States Patent [19]

Viitalahti

[11] Patent Number: 6,163,891

[45] Date of Patent: Dec. 26, 2000

[54] PROTECTOR FOR HOCKEY PLAYER

[76] Inventor: Kari Arto Olavi Viitalahti, Suomensaarenkatu 2 B 7, FIN-33410, Tampere, Finland

[21] Appl. No.: 09/403,230

[22] PCT Filed: Apr. 17, 1998

[86] PCT No.: PCT/FI98/00335

§ 371 Date: Oct. 15, 1999

§ 102(e) Date: Oct. 15, 1999

[87] PCT Pub. No.: WO98/47575

PCT Pub. Date: Oct. 29, 1998

[30] Foreign Application Priority Data

Apr. 17, 1997 [FI] Finland ..... 971627

[51] Int. Cl.[7] ..... A42B 3/04

[52] U.S. Cl. ..... 2/422; 2/421; 2/425; 2/468

[58] Field of Search ..... 2/468, 415, 422, 2/425, 410, 411, 424, 2.5, 455, 421

[56] References Cited

U.S. PATENT DOCUMENTS

| | | | |
|---|---|---|---|
| 1,872,877 | 8/1932 | Bowers . | |
| 3,123,831 | 3/1964 | Wells et al. . | |
| 3,825,952 | 7/1974 | Pershing et al. | 2/205 |
| 4,324,003 | 4/1982 | Johnston | 2/468 |
| 4,333,179 | 6/1982 | Laurita | 2/468 |
| 4,449,251 | 5/1984 | Gauthier | 2/468 |
| 4,686,710 | 8/1987 | Marston et al. | 2/468 |
| 4,697,289 | 10/1987 | Luigi | 2/422 |
| 4,881,529 | 11/1989 | Santos | 2/468 |
| 4,887,319 | 12/1989 | Daniels | 2/410 |
| 5,095,550 | 3/1992 | Perlinger | 2/422 |
| 5,212,837 | 5/1993 | Gose et al. | 2/172 |
| 5,893,174 | 4/1999 | Primeau | 2/424 |
| 5,946,719 | 9/1999 | Crupi et al. | 2/6.5 |

*Primary Examiner*—Michael A. Neas
*Attorney, Agent, or Firm*—Larson & Taylor PLC

[57] ABSTRACT

A protection for a player on skates, mainly meant to protect the player's neck, having the quality especially to protect against cuts caused by the skate blade. The protection is a flexible safety equipment to be fitted around the neck and having at least one joint (8) which can be opened so that the protection can be put on the neck and taken off the neck. The protection includes a fastening device (3) in order to be joined to a helmet (1) and at least a portion of the protection material is flexible woven fabric.

8 Claims, 3 Drawing Sheets

PROTECTOR FOR HOCKEY PLAYER

The invention relates to a protection for a player on skates, especially meant to shield the player's neck against wounds caused by the skate blade.

Typically, players on skates use numerous protections of various kinds to shield themselves against the tumults of play, playing gear, hits of the stick and kicks of the skate. Mainly, the protections are shock absorbing pads and hard shields. The main users are ice hockey players, bandy players and ringette players. Most of the protections used today are regulated to be as obligatory in official or so called league matches, as a condition for player's insurance.

Known as shields protecting the player's throat are the goal-keeper's safety mask, if it covers the throat area, further known is a separate pendent shield that protects the goal-keeper's neck hanging loose from the helmet, the safety mask or the throat, for instance, so that it places itself on the neck area. The players are known to have a neck protection, typically like a raised ring-shaped collar. Typically, this is a ring with self-adhesive fastening and made stiff enough in order to retain its posture and stay in place.

Hard shield type protections cannot be positioned to remain in place in every situation in order to protect the throat and, at the same time, allow free motion of the head. The above described ring collar cannot be very high either, it would disturb the head motions too much. Therefore, a part of the throat would be unprotected. As to their design, none of the presented protections is made to protect in the best possible way the player against wounds caused by a sharp skate blade. The above protections are also designed to absorb shocks from playing gear, i.e. sticks and discs.

By means of the neck protection as per this invention the present shortcoming of the neck portion protection is eliminated and the invention is characterized in what is described hereafter.

The advantage of the invention is the woven flexible fabric made of cut-resistant fibre or metal wire used as material in the protection against cuts of the skin by a skate blade, thus avoiding serious injuries in possible tumbling situations, when another player skates over the one on the ice. The protection falls over the whole neck area, because the fabric settles easily down in all situations, the protection allows free turning of the head as well as all neck motions. The protection material does not cause any rash and due to the mesh fabric the protection is more airy than known neck protections made of cloth with filling, and the protection is user friendly, since it is fastened to the helmet or safety mask in a way that makes it easy to put it on about the neck and to take it off the neck.

In the following the invention is disclosed with reference to the enclosed drawing, where FIG. 1 is a helmet with a protection as per the invention fastened to it.

Figure 1:
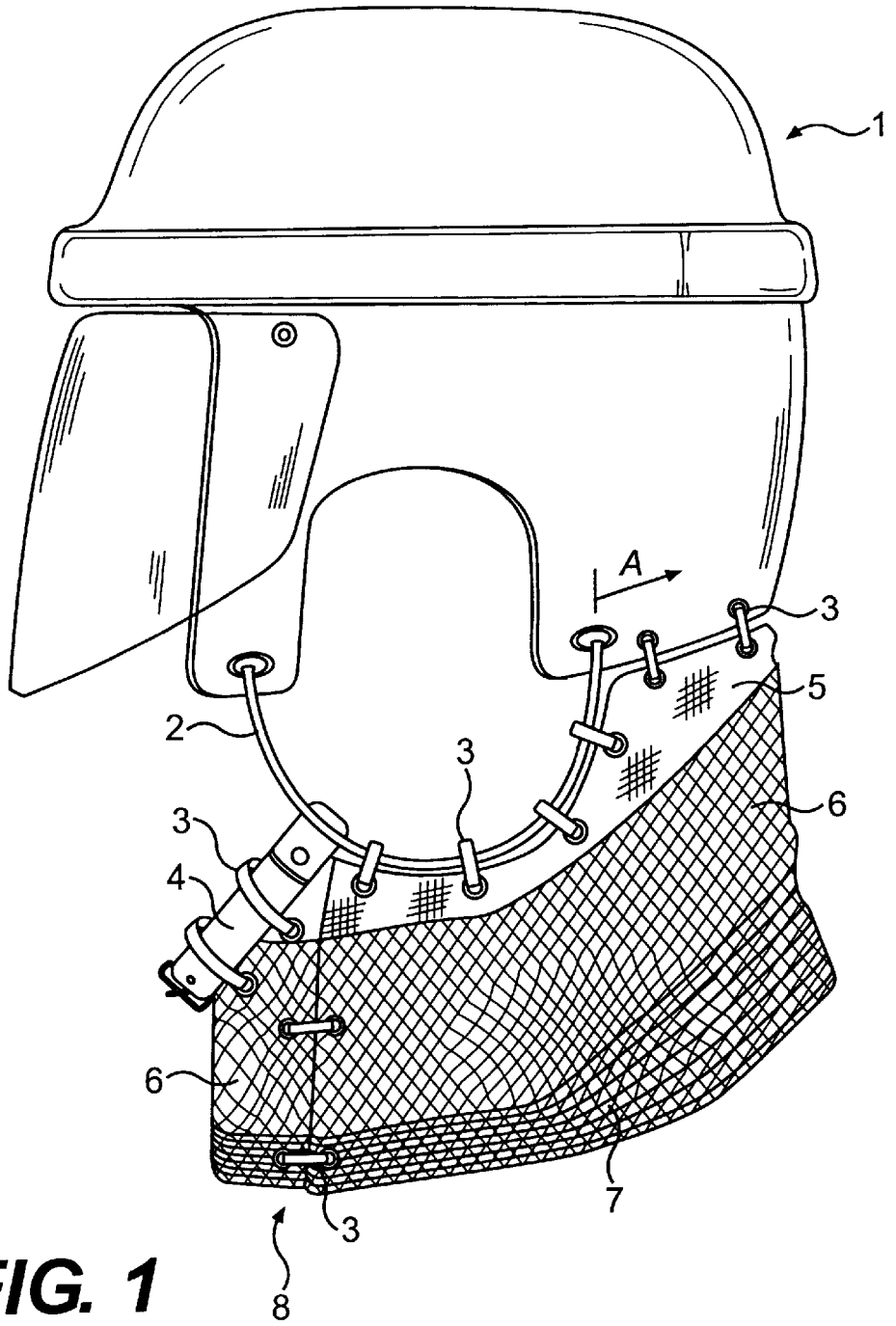
Figure 2:
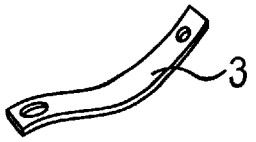
FIG. 2 is a fastener.

FIG. 1 shows a neck protection as per the invention fixed to the helmet of a player on skates. By means of several fasteners 3 the armour is suspended from the lower helmet edge to settle down fully around the neck. Most suitably the helmet has holes through which, for instance, fasteners 3 as per FIG. 2 are passed, as well as through protection 5, then folded and secured with the press-studs in the fastening means, for instance.

By the player's ear there is a loop (2) in the helmet, which is also used as fixing point for that portion. In the example in FIG. 1 the helmet has a chinstrap 4 which, known as such, can be opened. The armour is suspended from the chinstrap still with fastening means 3. Thus the armour can be suspended from the helmet in the example as a protection fully covering the neck.

The protection has a joint 8 so that the protection can be opened in order to put it on and take it off the neck along with the helmet. The joint has a sufficient number of quick-release fasteners 3, which can be opened and closed like the chinstrap 4 when the helmet is put on and taken off. Most suitably joint 8 is arranged just about chinstrap 4, which makes the use of the combination helmet and protection most easy. Joint 8 is either in the chinstrap area or by the end of it, as shown in FIG. 1.

The protection itself is at least partly a woven fabric, most suitably wire-cloth, which is flexible and moves in all directions. The protection can be composed of many parts, and each part need not be wire-cloth. In FIG. 1 the portion 6 and portion 7 and portion 5 can be made of stiffer cloth, flexible sheet or similar.

Figure 3:
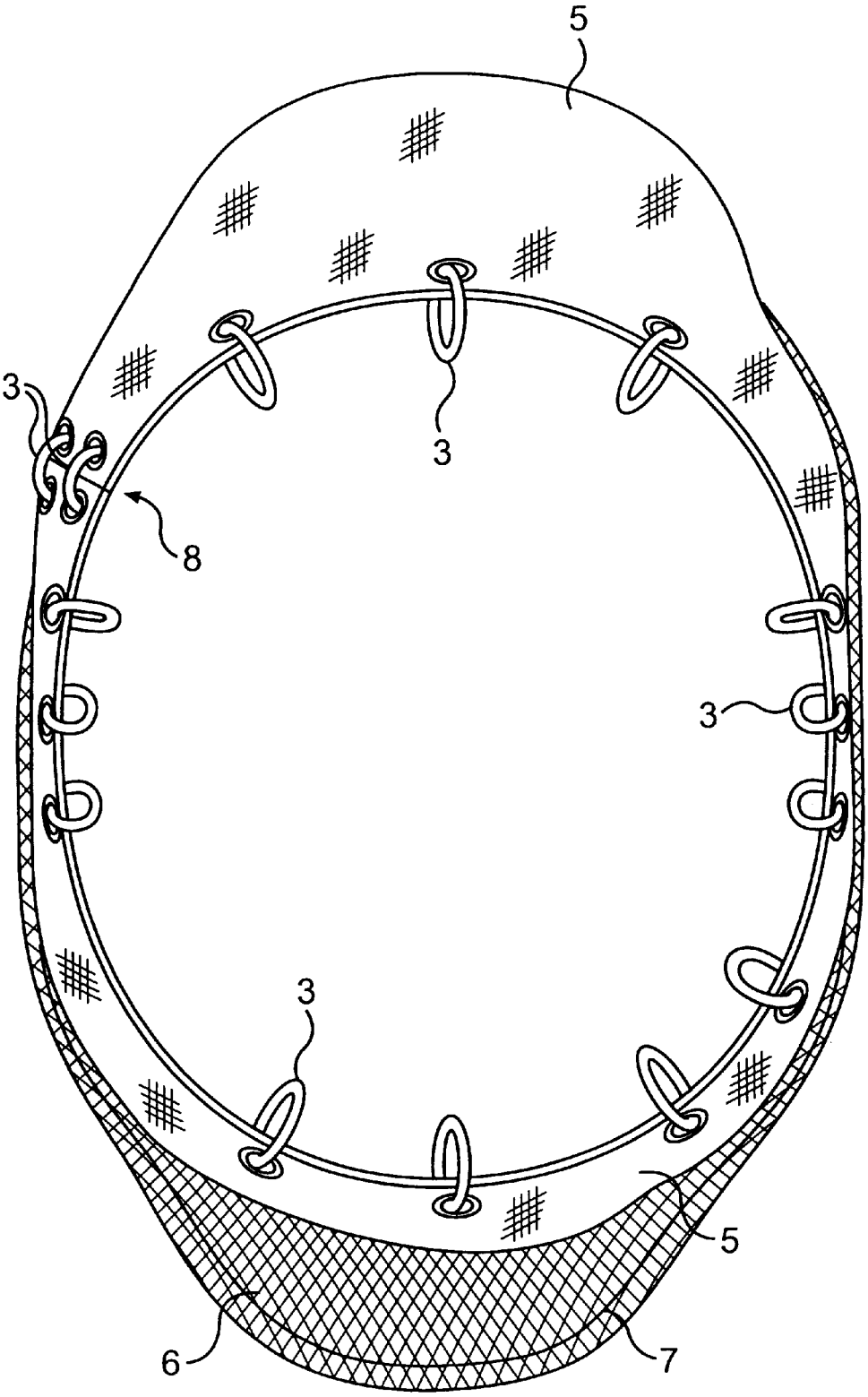
FIG. 3 is a protection as per FIG. 1 viewed from above.

FIG. 3 shows a protection as per FIG. 1 viewed from above without helmet. The front of the protection is shown in the upper part of the figure. The protection encloses the neck and has a joint 8 that can be closed and opened by means of quick-release fasteners 3. Means 3, necessary for suspension or fastening, are placed with appropriate spacing in the edge of the protection.

The protection, freely suspended, is appr. 10–15 cm high. The front and back portions of the protection are made higher than the shoulder portion. The protection turns partly with the head, but the most general situation is, however, head forward, the protection then in the best possible position.

The wire-cloth of the protective material is a mesh fabric and easily moving, the proper mesh size of which can in the practise be selected within the range from 1 to 10 mm. A beneficial quality of the woven fabric is also its becoming vertically shorter. The stiff wire-cloth loops move in regard to one another so that upon need the protection collapses vertically and gets low. This quality as well as the slight deformation friction of the fabric hardly disturbs the head motions.

Figure 4:
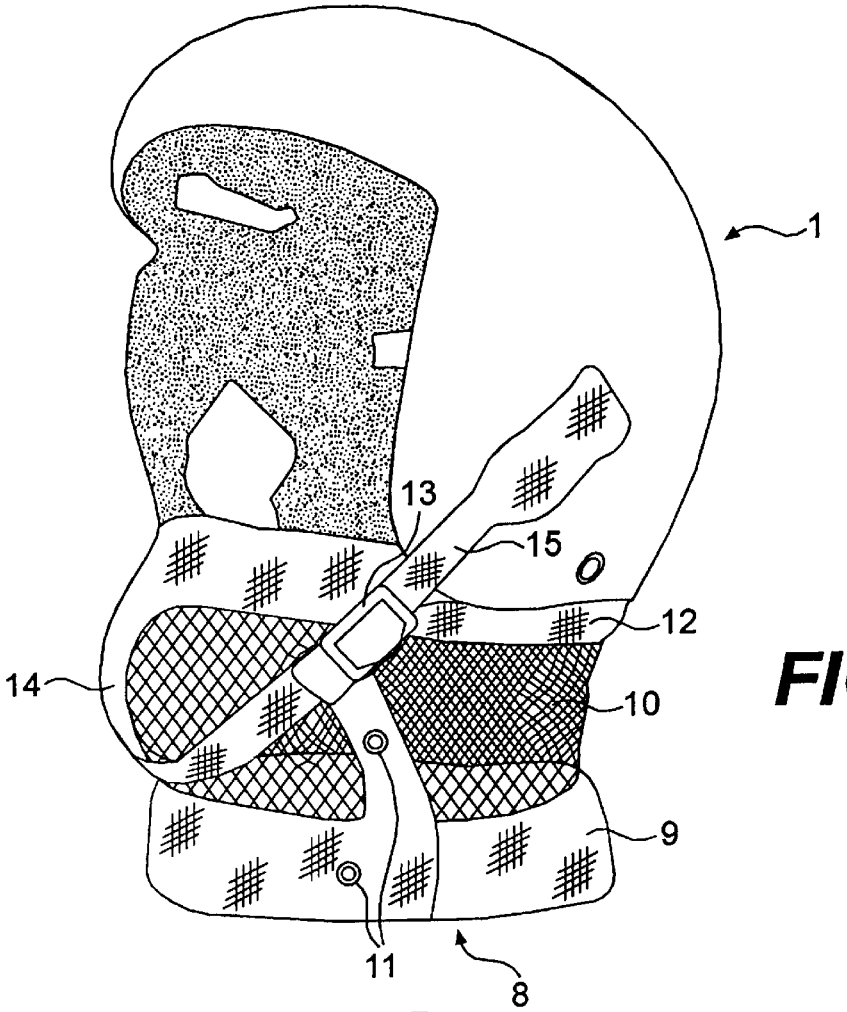
FIGS. 4 and 5 show an alternative protection.
Figure 5:
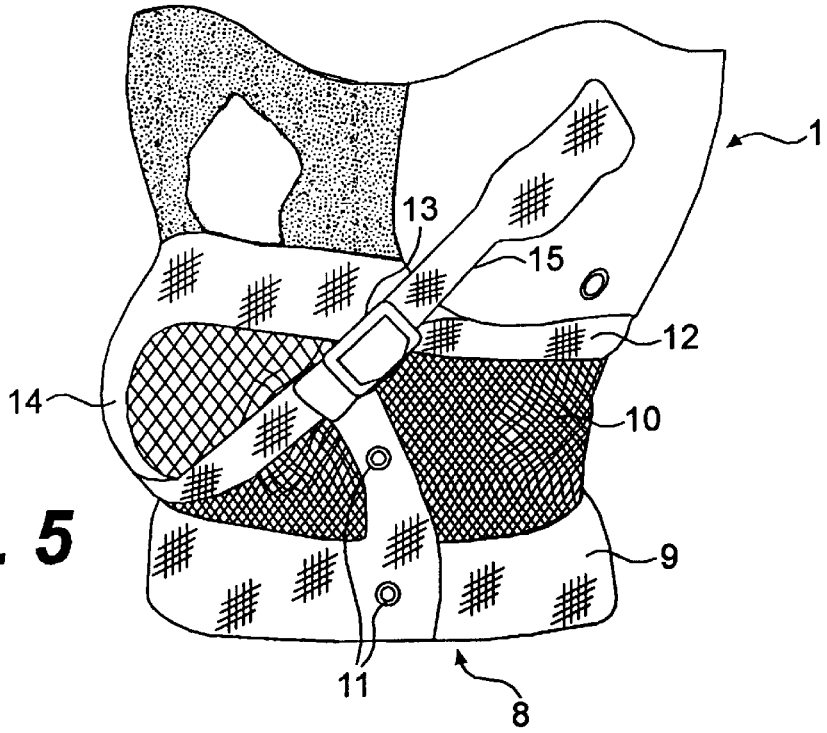

FIGS. 4 and 5 show a mesh fabric 10 made of cut-resistant fibre and its upper edge 12 and lower edge 9, which are made of stronger fabric. Upper edge 12 is by means of Velcro tape, glue or fastening means 15 fitted to the lower edge of a helmet. The upper edge is converted into a chinstrap 14 by the chin. The protection is a ring that can be opened, i.e. it breaks off in joint 8, which is a press-stud joint. The other portion of the chinstrap, strap 15, has an adjusting buckle 13 and in the end of this strap portion there is either a Velcro tape or a press-stud, by means of which portion 15 is fastened to and released from strap 14. As to the other part of the protection, it is opened with press-studs 11, whereby the ring protection gets open and the helmet with the protection fitted to it can be taken off.

Many different solutions can be used for fastening the protection to a helmet or a safety mask. With regard to the helmet hull, the fastening portion and the hull can be built together, as a construction that cannot be opened, already when and the helmet is manufactured. The back portion of the helmet hull can come then into question, i.e. portion A in FIG. 1. The fastening of the protection front side to the chinstrap can be opened as well as the cross-joint in the protection. The cross-joint in the protection is necessary, since the protection cannot be made stretchable to an extent allowing putting it on over the head.

The quality and type of fastening means can differ from the presented ones, meant for spot fastening, to means used for continuous fastening, like zippers or other similar means used by the clothing industry. Among these are, for instance, Velcro straps, press-studs, buttons, buckles, rivets, screws and similar low-construction space-saving means.

What is claimed is:

1. An apparatus for a skater which protects a neck of the skater comprising:

a helmet which is placed on a head of the skater, said helmet including a chinstrap which holds said helmet to the head of the skater;

a protection member attached to said helmet so as to encircle and protect a neck of the skater, said protection member being made of a material which protects against cuts from a skate blade, said protection member including a joint by which said protection member can be opened and removed from the neck of the skater; and a fastening means for fastening a portion of said protection member to said chinstrap of said helmet with said joint of said protecting member adjacent to said chinstrap whereby said protecting member is adapted to be opened at said joint to allow said protection member to be placed about and removed from the neck of the skater.

2. An apparatus for a skater as claimed in claim 1:

wherein said chinstrap of said helmet includes a side portion; and wherein said fastening means fastens said joint of said protecting member at said side portion of said chinstrap.

3. An apparatus for a skater as claimed in claim 1, wherein said protection member includes a ring made of a cut-resistant fiber.

4. An apparatus for a skater as claimed in claim 1, wherein said protection member includes a ring made from wire cloth.

5. An apparatus for a skater as claimed in claim 4, wherein the wire cloth includes one of titanium and a titanium mixture.

6. An apparatus for a skater as claimed in claim 1:

wherein said chinstrap of said helmet includes an opening; and wherein said fastening means fastens said joint of said protecting member at said opening of said chinstrap such that said chinstrap and said protection member open together.

7. An apparatus for a skater as claimed in claim 1, wherein said chinstrap includes a flexible woven fabric and wherein said protection member includes a ring which is made of a same flexible woven fabric as that of said chinstrap.

8. An apparatus for a skater as claimed in claim 1:

wherein said helmet includes a back portion; and wherein said fastening means fastens said protection member to said back portion.

* * * * *